US005509705A

United States Patent [19]

Woodsum

[11] Patent Number: 5,509,705

[45] Date of Patent: Apr. 23, 1996

[54] RATCHET SOCKET HOLDING TOOL AND METHOD OF USE

[76] Inventor: David A. Woodsum, 2623 Gladiolus St., New Orleans, La. 70122

[21] Appl. No.: 344,869

[22] Filed: Nov. 25, 1994

[51] Int. Cl.[6] ..... B25B 33/00

[52] U.S. Cl. ..... 294/1.1; 294/19.1; 81/3.43; 81/64

[58] Field of Search ..... 294/15, 19.1, 31.2, 294/58, 1.1; 81/3.43, 64, 65, 487, 488; 16/114 R; 119/799, 803, 804

[56] References Cited

U.S. PATENT DOCUMENTS

| | | | |
|---|---|---|---|
| 1,071,457 | 8/1913 | Old | 81/3.43 |
| 1,850,255 | 3/1932 | Amble | 119/803 |
| 2,522,190 | 9/1950 | Mouser | 294/19.1 |
| 3,200,676 | 8/1965 | Pagel | 81/64 |
| 4,532,833 | 8/1985 | Downs | 294/31.2 |
| 4,950,015 | 8/1990 | Nejib et al. | 294/19.1 |

*Primary Examiner*—Dean Kramer

[57] ABSTRACT

A tool for grasping a ratchet socket to stop the socket from turning during reverse strokes of the ratchet. The tool comprises a looped flexible belt connected at one end to an adjustable bar and connected to a spring biased rod at the other end. A slidable trigger is connected to the spring biased rod to permit the loop in the flexible belt to be enlarged for slipping over the socket. When the trigger is released the loop grips the socket and frictionally holds the socket from turning on the reverse stroke of the ratchet.

4 Claims, 3 Drawing Sheets

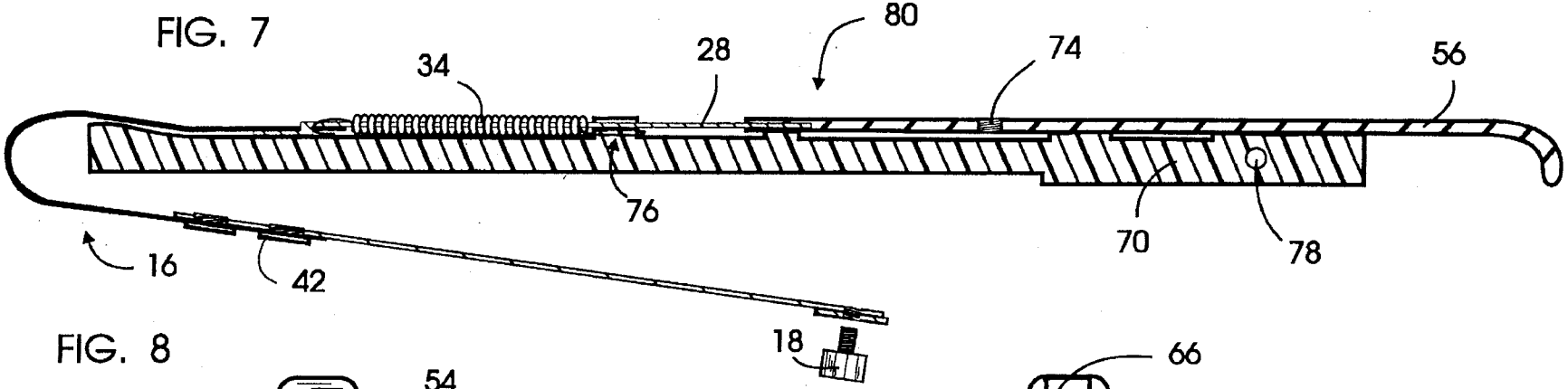
FIG. 7
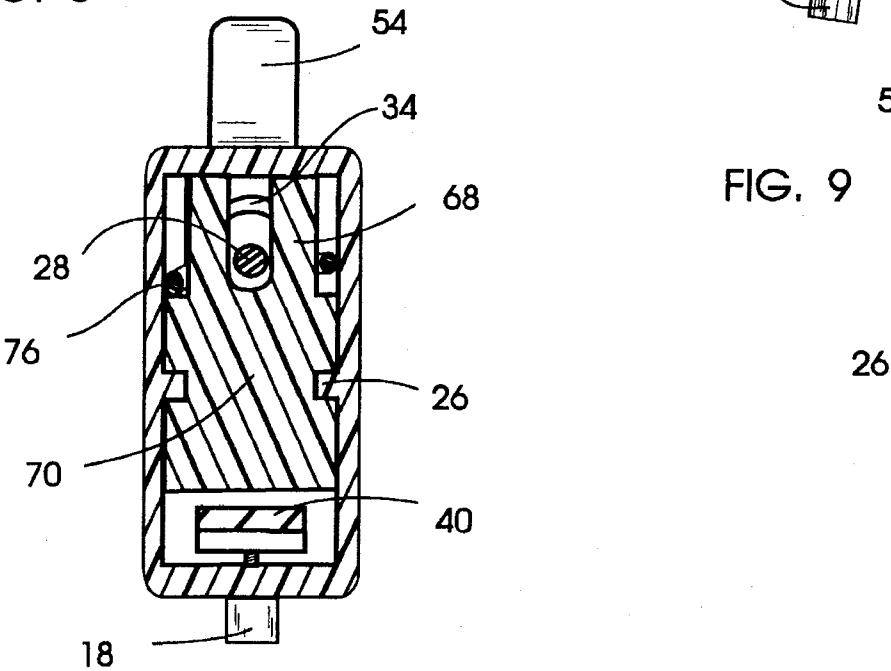
FIG. 9
FIG. 8

RATCHET SOCKET HOLDING TOOL AND METHOD OF USE

BACKGROUND OF THE INVENTION

The present invention relates to tools for holding ratchet sockets to prevent the sockets from turning during reverse strokes of the ratchet.

A common and frustrating problem encountered by mechanics involves the installation or removal of a nut or bolt with a ratchet where the ratchet and socket are in a location which cannot be reached by hand to stop reverse turning of the socket. When a nut or bolt is very loose a ratchet, being used with a socket to remove or tighten the nut or bolt, will have sufficient friction on the reverse stroke to keep the ratchet from working. To have the socket turn in only the intended direction the socket must be held with sufficient force to allow the ratchet to function.

SUMMARY OF THE INVENTION

The tool of the present invention comprises a handle with an adjustable flexible belt. The belt extends from the end of the tool in a form of a loop. One end of the belt is connected to an adjustable bar with the other end of the belt connected to a push rod and a tension spring. A thumb-activated slidable trigger member is connected to a push rod. As the slidable trigger is slid along the handle the push rod moves one end of the belt thereby enlarging the loop extending from the end of the handle. As the push rod is moved the tension spring is extended. When the trigger is released the tension spring draws the loop in the belt tight around a socket over which the belt loop has been positioned. The end of the flexible belt connected to the adjustable bar permits an operator to adjust the size of the loop so the tool may be used on various socket sizes.

To use the tool an operator first adjust the size of the loop in the belt to be slightly smaller than the circumference of the socket being used. The trigger is then slid to extend the tension spring and enlarge the loop. The enlarged loop is then placed over the socket. With the loop positioned around the socket the trigger is released and the spring tension draws the loop against the socket. The spring maintains tension on the belt to provide a frictional resistance against turning of the socket. The socket on the ratchet is then fitted onto a nut or bolt to be turned. As the ratchet handle is turned in the desired direction the socket will slide within the loop and the nut or bolt will be turned. On the reverse stroke of the ratchet the frictional contact of the belt around the circumference of the socket will hold the socket from turning and permit the ratchet handle to turn. Where more frictional resistance is needed to keep the socket from turning than is provided by the tension spring, the ratchet socket can be gripped even more firmly by pressing back against the trigger with the thumb. This will pull the friction belt tightly around the socket creating as much friction as necessary to keep the socket from turning backwards. After the nut or bolt has been turned to the desired degree the socket is removed and the trigger pressed to enlarge the belt loop and release the loop from the socket.

Accordingly, a primary object of this invention is to provide a novel friction tool which is compact, easy to construct and may be operated with one hand.

A further object of the invention is to provide a tool for frictionally holding a ratchet socket from turning during its reverse stroke.

Another object is to provide a grasping tool for grasping objects in difficult to reach places or where for safety purposes it is necessary to keep hands clear of object being manipulated.

Yet another object is a novel method of using a ratchet socket grasping tool.

Various attachments are contemplated to adapt tool for each unique purpose.

BRIEF DESCRIPTION OF THE DRAWINGS

In the drawings, where like reference numerals are used to indicate identical components in the various Figures:

FIG. 7 is a longitudinal partial cross-sectional view of a core assembly of the tool of FIG. 4;

FIG. 8 is an enlarged cross-sectional view taken along line 8—8 of FIG. 6; and FIG. 9 is an enlarged cross-sectional view taken along line 9—9 of FIG. 6.

DESCRIPTION OF THE PREFERRED EMBODIMENT

Figure 1:
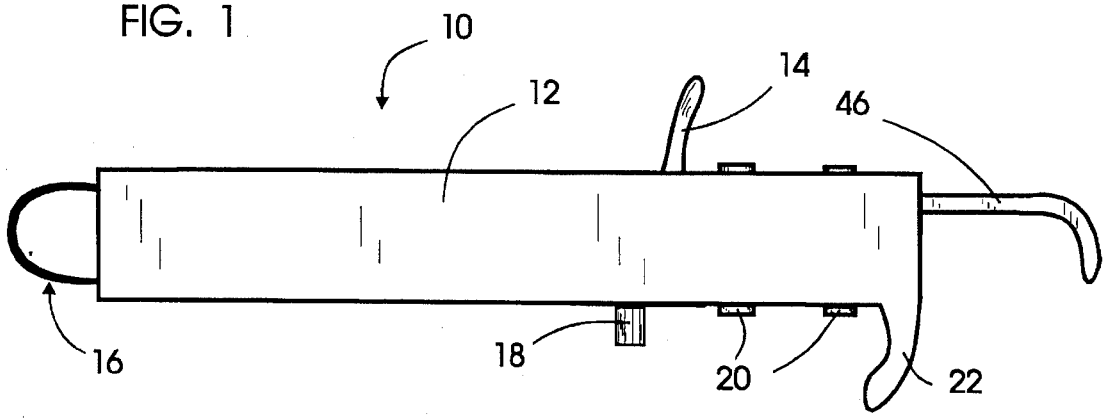
FIG. 1 is a side plan view of a socket grasping tool.
Figure 2:
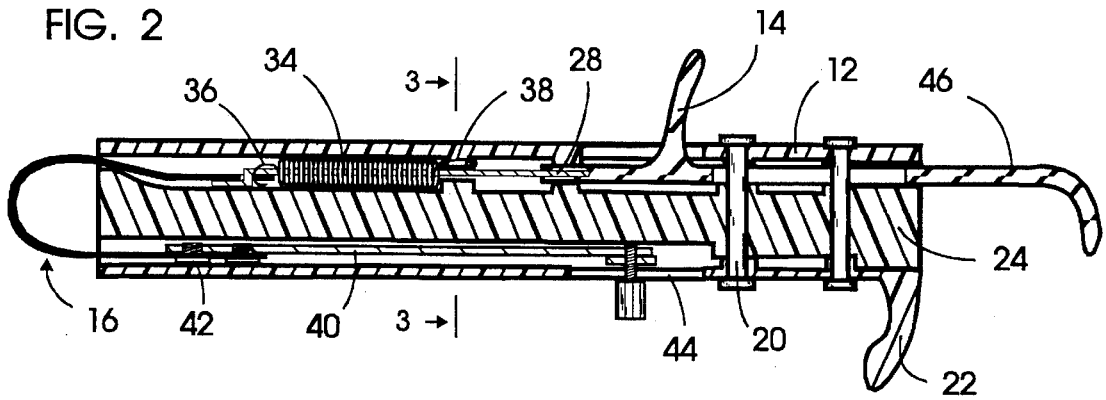
FIG. 2 is a longitudinal partial cross-sectional view of the tool of FIG. 1.
Figure 3:
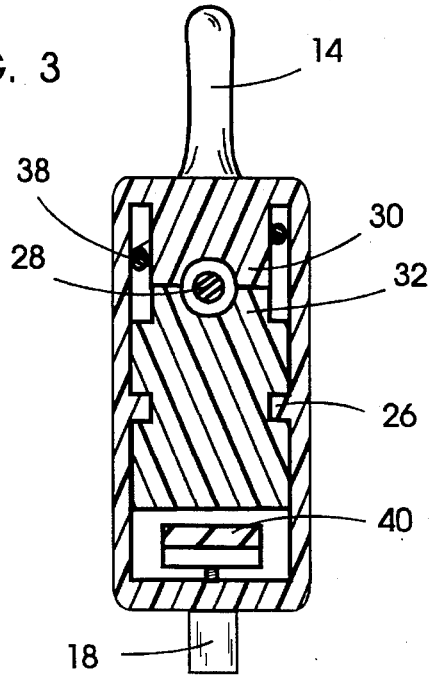
FIG. 3 is an enlarged cross-sectional view taken along line 3—3 of FIG. 2.
Figure 4:
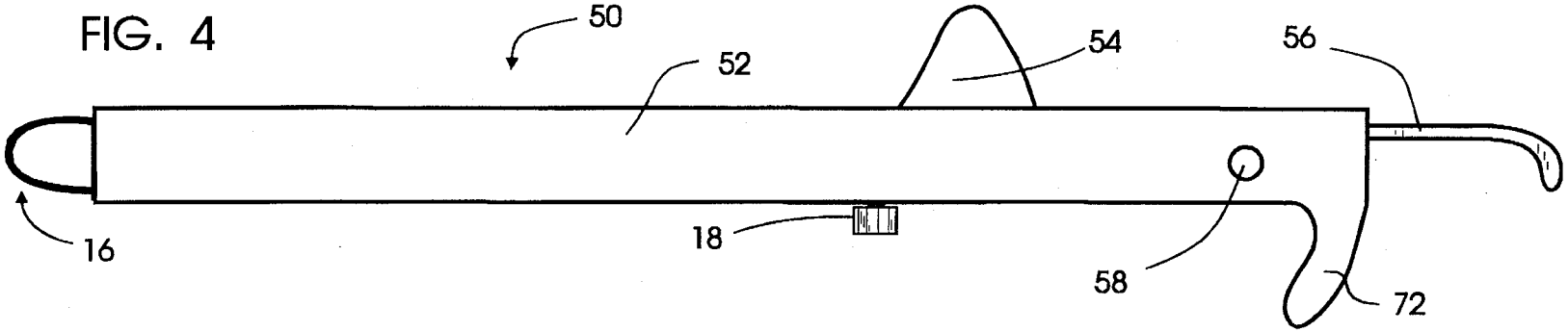
FIG. 4 is a side plan view of another embodiment of a socket grasping tool.
Figure 5:
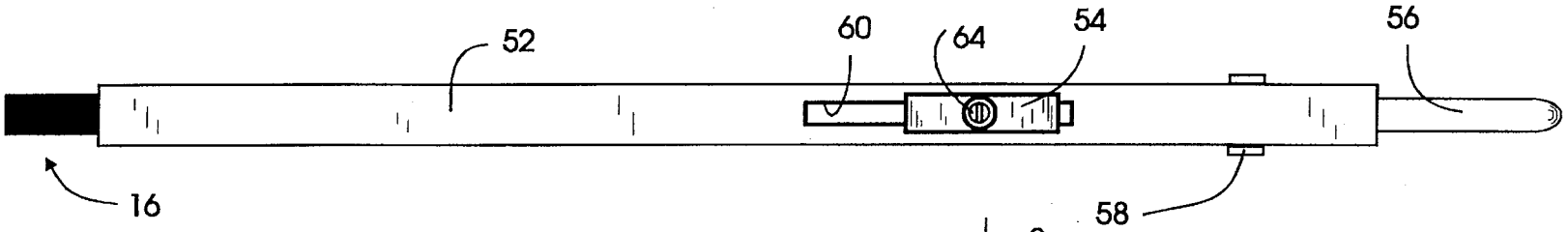
FIG. 5 is a top plan view of the tool of FIG. 4.
Figure 6:
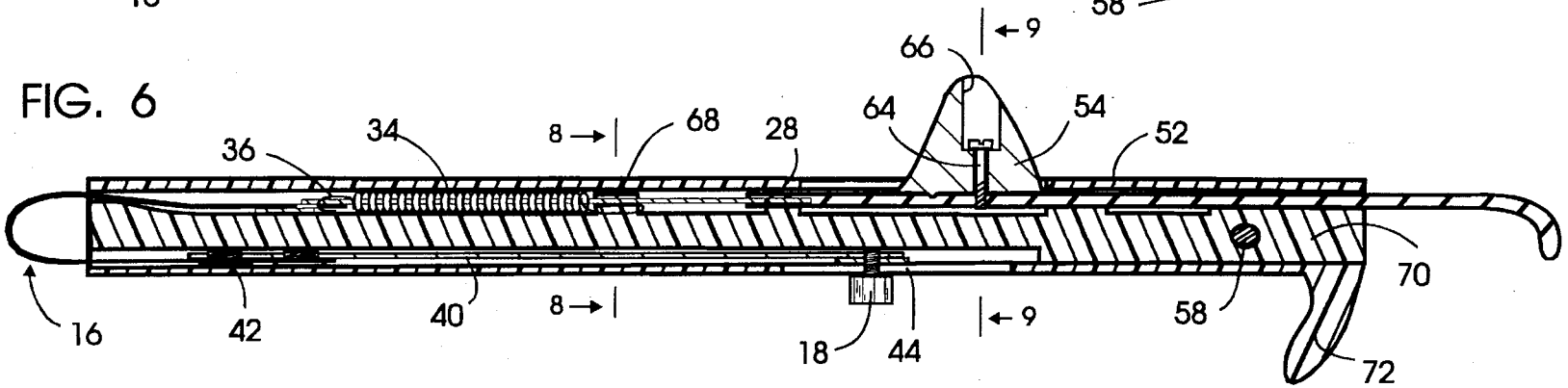
FIG. 6 is a longitudinal partial cross-sectional view of the tool of FIG. 4.

With reference to FIGS. 1, 2 and 3, a ratchet socket clamping tool 10 comprises handle housing 12, loop adjusting slidable trigger 14 connected to slider 46, grasping belt 16 which may be constructed of a reinforced composition or tough rubber strap, and adjusting knob 18. When a mechanic needs to hold a ratchet socket from turning on the back stroke and is unable to reach the socket by hand, the socket clamping tool 10 is first adjusted so the grasping belt 16 forms a loop which is smaller than the socket being used. This adjustment is made with the adjusting knob 18. After the initial adjustment is made, trigger 14 is moved in the direction of the belt 16 which slides slider 46 pushing rod 28 connected to the end of belt 16 to enlarge the belt loop. The enlarged belt loop is then positioned over the socket and trigger 14 released to permit the belt loop to frictionally grasp the socket. With clamping tool 10 being held in one hand the ratchet may be operated with the other hand. The socket is thereby held from turning on the reverse stroke of the ratchet.

As illustrated in FIGS. 2 and 3, core 24 is held in position with projections 26 extending along the interior sides of housing 12. Push rod 28 is attached to slider 46 and passes between guide member 30 on housing 12 and guide member 32 on core 24. The push rod 28 extends through helical tension spring 34 and is connected to grasping belt 16 through an opening in belt 16. Tension spring 34 is connected to the opening in grasping belt 16 with a spring loop 36 at one end and to the guide member 30 at the other end with a spring loop 38. As trigger 14 is pushed to enlarge the loop in grasping belt 16, tension spring 34 is expanded. Upon releasing the trigger 14, tension spring 34 will contract and maintain a tension on grasping belt 16 to hold a socket within the grasping belt loop.

With one end of the grasping belt 16 connected to rod 28 and spring 34 the other end is connected to adjusting bar 40 with screws 42. To initially adjust the size of the belt loop, adjusting bar 40 is moved longitudinally by loosening adjusting knob 18, which clamps the adjusting bar 40 against the inside of housing 12, and longitudinally sliding the knob in slot 44.

The socket grasping tool housing 12 and core 24 can be constructed of plastic material by molding or extruding and is easily assembled by first connecting the grasping belt 16 to spring 34 and rod 28. The spring loop 38 with push rod 28 and slidable trigger 14 on slider 64 are positioned within the housing 12. Core 24 can then be slid into position inside of the housing 12 with rivets or bolts 20 installed to hold the core 24 in position. Grasping member 22 on housing 12 provides an operator using the tool an easy grip so the tool can be operated with one hand.

With reference to FIGS. 4–9 a more preferred embodiment is illustrated. This embodiment is relatively long and slender with the ability to be used in smaller areas. The more preferred embodiment may be easily constructed without the need to preinstall the spring and slider within the housing prior to the installation of the core member.

As shown in FIGS. 4–9, a ratchet socket clamping tool 50 has essentially the same components and functions in substantially the same manner as the embodiment illustrated in FIG. 1. Clamping tool 50 has been specifically designed for easy construction with the slender dimensions of the handle housing 52. The interior surface of housing 52 is constructed with a smooth longitudinal surface that lends itself to being extruded from a plastic material. Projections 26 along the sides of the housings fit in complimentary grooves formed in the sides of core 70.

Clamping tool 50 may be easily constructed by first assembling core assembly 80 as shown in FIG. 7. Grasping belt 16 attached to push rod 28 and spring 34 along with slider 56 is positioned on core 70. Spring loop 76 is placed over fingers 68 and push rod 28 is positioned between the fingers 68. Adjusting bar 40 is attached to grasping belt 16 with screws 42 and positioned on core. After core assembly 80 is assembled it may then be slid into housing 52 where the threaded hole 74, in slider 56 will be located along the slot 60 in the top of housing 52. Trigger 54 may then be placed into slot 60 and held in position with bolt 64 located in recessed hole 66 in trigger 54. The final assembly of clamping tool 50 is accomplished by adjusting knob 18 to the adjusting bar 40 through slot 44 in the bottom of housing 52. The core assembly 80 is locked into position inside of housing 52 with a bolt or rivet 58 passing through hole 78 in core 70. Grasping member 72 provides an easy hand grip for clamping tool 50.

Various modifications and changes in materials and design are contemplated and may obviously be resorted to without departing from the function or scope of the invention, as hereinafter defined by the appended claims. For example, the grasping belt could be provided with friction enhancing means such as teeth or notches to aid in the flexing or friction holding characteristics of the belt.

What is claimed is:

1. A tool for holding a ratchet socket comprising a handle housing, a core member, a trigger extending through a slot in said housing and connected to a slider, said slider is connected to a push rod, said trigger, slider and push rod slidably held for movement in the longitudinal direction of said housing, an adjustable bar slidably positioned within said housing, and a flexible grasping belt connected at one end to said adjustable bar and at the other end to said push rod, a tension spring with an end connected in said housing and the other end connected to said flexible grasping belt, said tension spring is provided with at least one spring loop, said spring loop is positioned around a push rod guide member in said housing, said flexible grasping belt extends from one end of said housing to form a loop whereby a ratchet socket positioned in said loop may be held under tension of said spring.

2. A tool for holding a ratchet socket comprising a handle housing, a core member, a trigger extending through a slot in said housing and connected to a slider, said slider is connected to a push rod, said trigger, slider and push rod slidably held for movement in the longitudinal direction of said housing, an adjustable bar slidably positioned within said housing, and a flexible grasping belt connected at one end to said adjustable bar and at the other end to said push rod, a tension spring with an end connected in said core and the other end connected to said flexible grasping belt, said core member has a pair of fingers, said tension spring has at least one spring loop, and said spring loop is positioned around said fingers, whereby the push rod is slidably held between the fingers and said housing, said flexible grasping belt extends from one end of said housing to form a loop whereby a ratchet socket positioned in said loop may be held under tension of said spring.

3. A method of using a tool for holding a ratchet socket from turning on the back stroke of said ratchet while being used to turn a nut or bolt; comprising the steps of adjusting the size of a flexible grasping belt loop extending from the end of said tool to be slightly smaller than said ratchet socket, pressing a slidable trigger attached to a push rod to enlarge said belt loop by pushing one end of the belt loop toward the end of the tool handle, said push rod is connected to the end of said flexible grasping belt, fitting said enlarged belt loop over said ratchet socket, releasing the pressure on said slidable trigger to permit a tension spring attached to the end of said flexible belt to pull said belt loop tightly around said socket, holding said tool with one hand while operating said ratchet with the other hand to turn a nut or bolt in a desired direction, and removing said tool from said socket by again pressing said trigger to enlarge said belt loop.

4. The method according to claim 3 comprising an additional step after said releasing step of pressing back against said slidable trigger to create additional frictional resistance between said flexible grasping belt and said ratchet socket, whereby said frictional resistance between said belt loop and said ratchet socket may be increased as necessary to keep the socket from turning backwards.

* * * * *